United States Patent [19]

Urresti

[11] Patent Number: 4,520,956

[45] Date of Patent: Jun. 4, 1985

[54] STAPLING MACHINE

[75] Inventor: Jose E. A. Urresti, Eibar, Spain

[73] Assignee: Olave, Solozabal y Cia., S.A., Eibar, Spain

[21] Appl. No.: 485,257

[22] Filed: Apr. 15, 1983

[51] Int. Cl.[3] ..... B25C 5/02; B25C 5/11

[52] U.S. Cl. ..... 227/120; 227/123

[58] Field of Search ..... 227/83, 119, 120, 123, 227/156

[56] References Cited

U.S. PATENT DOCUMENTS

| | | | |
|---|---|---|---|
| 1,679,662 | 8/1928 | Jahn | 227/123 X |
| 2,296,574 | 9/1942 | Rodgers | 227/120 |
| 3,583,622 | 6/1971 | Groeff | 227/120 |

FOREIGN PATENT DOCUMENTS

| | | | |
|---|---|---|---|
| 359686 | 10/1931 | United Kingdom | 227/123 |
| 647179 | 12/1960 | United Kingdom | 227/123 |

*Primary Examiner*—Paul A. Bell

*Attorney, Agent, or Firm*—Michael J. Striker

[57] ABSTRACT

A stapling machine, whose arms, of which one carries the stapling head and staple magazine and the other an anvil for bending them into shape, are constructed in a single piece body and are linked together about a weakened joint area with at least two leaves acting upon it or upon a cross stiffener in the same plane or at an angle to one another, and said arms being provided also with a guide arrangement which prevents any sideways bending between the arms. The stapling head incorporates in a frame with which it provided, a travelling assembly that consists of a front plate and cover which slide in guides provided on the frame, and are provided with a positioner whose flanges are capable of being housed within recesses in the front walls of said guides so that in the event of any jamming of staples inside the machine, the travelling assembly can be placed at an intermediate disassembly position.

14 Claims, 4 Drawing Figures

STAPLING MACHINE

BACKGROUND OF THE INVENTION

The present invention relates to the field of stapling machines. More particularly, it relates to a stapling machine having arms composed of a single piece.

Most prior stapling machines have two arms joined by a mechanism to allow rotation. Those staplers that have had both arms made to a single piece have the problems of sideways bending. Another problem, common to all staplers, is that when the stapler james disassembly of the head is required to remove the jammed staple.

SUMMARY OF THE INVENTION

The present invention is concerned with a new stapling machine, one of whose purposes is to make partial disassembly of the stapling head possible so that in the event of any blockage due to jamming or breakage of staples, or some similar cause, its travelling body, which includes the essential stapling components, can be raised with respect to the supporting frame, which is invariably joined to the stapling machine body with the possibility of axial travel with respect to one of its arms so as to allow staples to be loaded, and such raising, being made to at least two intermediate positions so as to provide access to the front of the machine without any need to dissassemble the stapling head thereof, and where the actual stapling machine body, upon being made from a single piece with no additional mechanism, allows mutual bending of its arms to a degree of flexing that allows total return to the initial position as soon as the force ceases to be applied.

Another of the purposes of this invention is to achieve, without any auxiliary mechanisms, a centre of rotation in the area of the join between the arms, to stiffen this area of the join between the arms, and to remove the centre of bending as far away as possible from the stapling area in order to allow respectively the arms to return quickly to their normal position when the force ceases to be applied, and a practically parallel travel to take place between the arms in order to achieve a practically perpendicular application of the staples.

A further essential purpose of the invention is to prevent sideways bending between the stapling machine arms.

Yet another purpose of this invention is to achieve a wholly symmetrical structuring both as regards dimensions as well as materials so that both the rotation when a force to apply a staple is exerted, as well as the return motion when such force is removed, take place in a regular manner.

Accordingly, the present invention is concerned with a stapling machine whose rotating and return system is based upon at least two leaves which, possessing a certain thickness, form a single unit with the stapling machine arms, and are arranged in an area of join between these arms, so that the degree of stiffening, and hence the degree of recovery when the applied force is removed, is a function of these two factors: the number of leaves and the thickness thereof, and the area of join.

The supporting frame for the stapling head possesses at least two recesses located alternatively on the front and the rear face of its guide rails for its travelling structure which are located on the front. At the same time, on the travelling structure, and more specifically on the front plate and front cover, which are invariably joined together, there is a positioner which, being capable of crosswise travel between two outward positions, can house its side flanges inside the recesses provided in the guide rails, so that the assembly comprising the front plate, the front cover and the positioner can be arranged statically with respect to the supporting frame, this being the working position of the stapling machine, whose tongue and tongue carrier are capable of vertical travel between two end positions defined by an oblong hole in the front plate, or, when the positioner is moved crosswise, it will allow relative vertical travel (defined by the length of each recess provided in each guide rail) of the assembly of the front plate, front cover and positioner to take place with respect to the supporting frame.

Due to the fact that the working position is that which is achieved when the bottoms of the front plate, the front cover and the supporting frame are all upon a single horizontal plane, in any other position in which the front plate and the front cover undergo relative travel with respect to the supporting frame, the former will be higher than this latter and access will thereby be afforded from the front to the area where the staples are housed in the bottom of the supporting frame, thus allowing the stapling machine to be unjammed with no need of dissassembling the head.

Once the machine has been thus unjammed, the front plate and front cover assembly need only be shifted to its working position and the positioner inserted into the lowermost recess by means of appropriate crosswise travel in order for the stapling machine to be made ready once again for use.

According to one feature of the invention, the recesses provided in the guide rails and arranged in staggered formation so that the end of one does not necessarily coincide with the beginning of the next, located on the opposite rail, but instead goes slightly beyond it so that when the positioner comes into contact with the end of one of the recesses, the parts can travel crosswise in the opposite direction so as to begin their travel in the next recess.

According to another feature of the invention, each recess has its lower edge arranged at a slope so as to facilitate the insertion of the positioner therein, whilst its upper edge is at right angles to the guide so that the positioner is self-engaging therein and will not accidentally disengage or shift to the following recess.

To prevent sideways bending between the arms, the stapling machine is provided with a guiding arrangement on the arms themselves, one of which is formed into a guide recess for a perpendicular extension provided on the other arm so that in the normal or the proper working position, no contact takes place between the recess and the extension, but in the event of any sideways pressure, the recess becomes the guide for the perpendicular extension so as to prevent such sideways bending.

In order to provide a better understanding of this invention, the accompanying drawings show a practical construction of the stapling machine as a purely illustrative and not limitative example thereof.

DETAILED DESCRIPTION OF THE PREFERRED EMBODIMENTS

Figure 1:
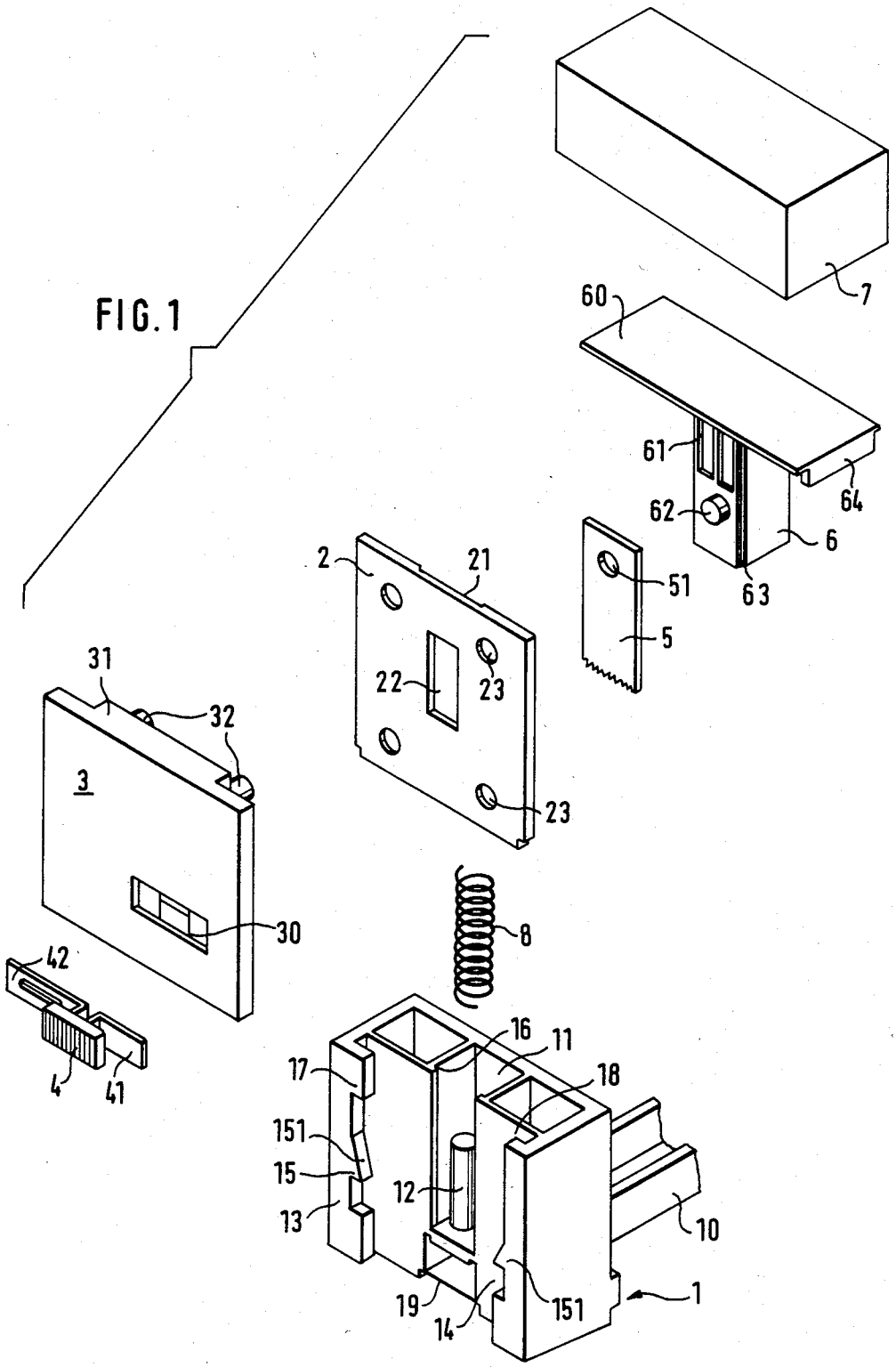
FIG. 1 is a general perspective view of the stapling machine head with all its parts and components assembled in position.
Figure 2:
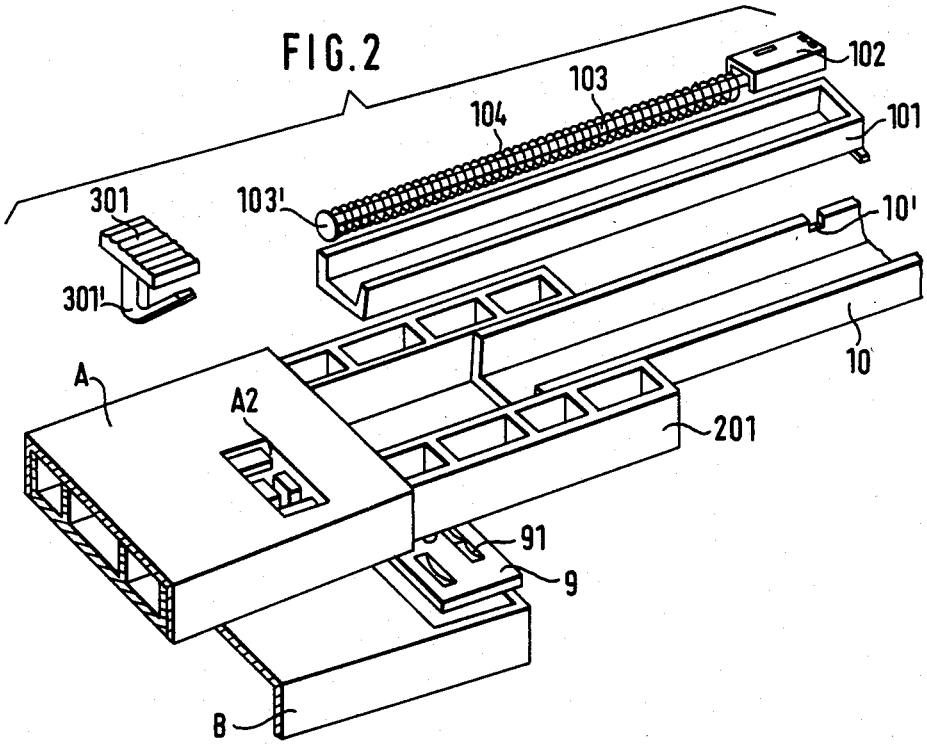
FIG. 2 is a general perspective view of the stapling machine body with all its parts and components assembled in position.

The purpose of the present invention is a new stapling machine in which there are embodied two arms (A) and (B) joined together at their rear by means of a return and rotating system which without any auxiliary mechanism, achieves the relative motion required between said arms (A) and (B) in order for the stapling action to take place. At the front, one of these arms carries a stapling head, and the other an anvil (9) to bend over the ends of the staples when they enter into shaped recesses (91) once they have pierced the sheets of paper to be stapled together.

In accordance with this invention, the rotating and return system which links arms (A) and (B) together at their rear takes the form of an area of join (8) in an arc, which is weakened with respect to the remainder of arms (A) and (B) and continues therewith, and in same a flexing motion takes place when a force is applied to arms (A) and (B) to accomplish stapling.

Also from these arms (A) and (B), there protrude at least two leaves (81) and (82) which reach as far as the vicinity of the point of rotation in the area of the join (8), with which they are linked by means of a cross stiffener (83) which takes up the whole or most of the width of the area of joint (8) and the leaves (81) and (82).

Figure 3:
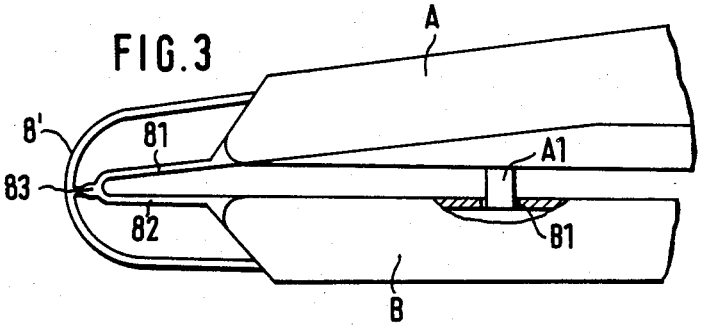
FIG. 3 illustrates an embodiment of the area of the join between the arms of a stapling machine according to the invention, and a section showing guiding means.

In the construction illustrated in FIG. 3, leaves (81) and (82) lie upon sloping surfaces or inclined planes converging upon the cross stiffener (83).

Figure 4:
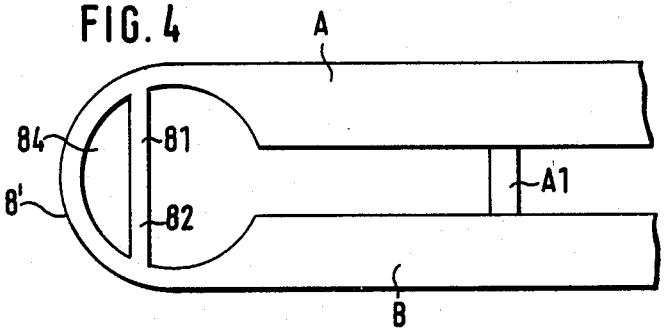
FIG. 4 illustrates an alternative embodiment of the area of the join between arms on a stapling machine according to the invention.

In the construction illustrated in FIG. 4, the leaves (81) and (82) lie upon the same plane as each other, and with the area of joint (8), they form a hollow circular segment (84). The cross stiffener (83) has been omitted from this construction.

In any event, these arrangements for the leaves (81) and (82) are those that have been proven as the most suitable for keeping the point of rotation away from the stapling area (between head and anvil (9)), and thus achieve motion between arms (A) and (B) which tends to be parallel in said stapling area, so that staples are applied at right angles.

As a contribution to this same purpose to make the staples be applied at right angles, one of the arms, like arm (A) for instance, may possess a bend in its front that carries the stapling head or the anvil (9).

The stapling head is in turn comprised of:

A supporting frame (1) with a rear extension (10) by means of which it is joined to the stapling machine body in such a way that it is capable of sliding lengthwise with respect thereto for the purpose of loading the staples.

An assembly comprised of a front plate (2) and a front cover (3) which are assembled on the front of the supporting frame (1), and which is capable of sliding upwards and downwards with respect thereto.

A tongue carrying shaft (6) which carries a tongue (5) also capable of undergoing upwards and downwards sliding motion when a pressure is applied thereto, and in particular to a head (7) which is fitted onto the widened head (60) of the tongue carrying shaft (6).

A spring (8) which, being fitted onto the supporting frame (1), causes the tongue carrying shaft (6) to return to its initial position when the force ceases to be applied.

The supporting frame (1) possesses a large sized central recess (11) whose bottom is fitted with a stub shaft (12), which carries the spring (8). Said recess (11) is open at the front and flanked on either side by a protruding guide (16) which runs up its whole height.

This supporting frame (1) also possesses two guide slots (18) on its front, which run up its whole height and which are flanked at the front by two guide walls (13) which define the face of the supporting frame (1).

Each one of these guide walls (13) possesses on the edge of its free side, a number of steps which comprise plain stops (15) and recesses (14).

These recesses (14), are correspondingly located on each side of the guide walls (13) at staggered consecutive heights.

Stops (15), arranged between each consecutive pair of recesses (14), possess a sloping bottom edge (151) which corresponds to a recess (14), and a top edge (17) which corresponds to that same recess (14) at right angles to each guide wall (13).

The front plate (2) is fitted onto the support frame (1) and engaged into the guide slots (18), while it possesses an oblong hole (22) in the vertical position and a groove (21) which extends up the whole height of the plate on one of the faces thereof.

Furthermore, a plurality of holes (23) are provided on this plate (2) to allow the front ccover (3) to be affixed thereto.

This front cover (3) thus fitted in position, invariably with plate (2) accommodating its protrusions (32) inside the holes (23) on the plate (2), these being expanded internally in same, possesses a front hole (30) where a positioner (4) is fitted.

This positioner (4) possesses two side flanges (41) and (42), which may be identical or different in size according to whether hole (30) is located centrally or not on the front cover (3), and said flange (41) and (42) allow the positioner (4) to travel crosswise in the hole (3) between two end positions.

The tongue carrying shaft (6) possesses in turn a bottom hollow which houses the end of spring (8), and said hollow may or may not extend along the whole length of the shaft (6); and a head (60) upon which a top cover (7) is fitted, while two side stops protrude from either side of said head (60) which moreover possesses a front stop (61) which, in conjunction with an assembly spigot (62), positions the tongue (5) when assembled in this area.

Said tongue (5) possesses a hole (51) for this purpose, the shape of which is the same as that of the assembly spigot (62).

The tongue carrying shaft (6) is assembled in such a way that it is guided on its side slides (63) by the protrusions (16) on the suppporting frame (1), while protrusion (62) is inserted through hole (51) to position the tongue (5), and terminates in a position inside hole (22) of the front plate (2) in whose recess (21), tongue (5) is housed in such a manner that there is a guided motion of the tongue (5), the tongue carrying shaft (6) and the top cover (7) which is where the force is applied. The motion of these travelling parts of the stapling machine is limited in the downwards direction by stops (64) when they abut against the top face of the supporting body (1), and in the opposite direction, which is covered through the action of spring (8), by protrusion (62) itself when it abuts against the upper face of the oblong hole (22).

Positioner (4) has one of its side flanges (41) and (42) housed in one of the recesses (14).

In the operating position, and in accordance with the construction shown on the drawings, flange (42) is accommodated in the bottom recess (14), so that the front plate (2) and front cover (3) assembly is positioned so that its bottom face is on the same plane as the bottom face of the supporting frame (1).

In the event of the stapling machine becoming jammed, it is simply necessary to shift the positioner (4) sideways so that its opposite side flange (41) engages inside the following and slightly higher recess (14) on the other guide wall (13). In this position, a view is available from the front over the area (19) where the staples are loaded.

In the case of a larger working area being required, then in this second position, it is simply necessary to shift the positioner (4) crosswise in the opposite direction from above, that is to say, until it is in the same position as it was before with respect to the front cover (3), so that its side flange (32), aided by the slope (151) in the following recess (14), engages inside said recess (14) located in the opposing side wall (13) so that the assembly comprising the plate (2) and front cover (3) is raised to a second position wherewith the staple outlet area (19) is left freer so as thus to facilitate its being unjammed.

By repeating this procedure over again (as in the illustration given, although in practice it can be done any number of times), that is to say, by shifting positioner (4) once more in the opposite crosswise direction, its side flange (42) is released from the recess (14), and its opposing side flange (41) is aided by the sloping stop (151) to engage in recess (14) immediately above guide (13) opposite to the aforementioned one.

In order to disassemble the head completely, it is simply necessary to repeat the above mentioned procedure until the last recess (14) is reached, whereupon the assembly comprising the plate (2), front cover (3), tongue (5), tongue shaft (6), top cover (7) and spring (8) can be disassembled and removed from the stapling machine body.

For the return to the working position, it is simply necessary to shift the above mentioned travelling assembly in the downwards direction, so that upon reaching the bottom stop (151) in the appropriate recess (14), and bearing in mind that same is sloped, positioner (4) interlocks in the next recess down (14), with the exception of the first recess (14), which belongs to the working position, where it is necessary to shift the positioner (4) sideways in order for its side flange (42) to engage in the next recess down (14).

The rear extension (10) on the stapling head (1) is invariably joined as shown to a tongue (101), and between this and said rear extension (10), there is a housing for the staples. These staples are compressed towards the stapling head (1) by a thruster (102) inserted inside arm (A) by means of shaft (103) around which spring (104) is placed and is in abutment with a head (103') provided at the end of shaft (103), and with the actual thruster (102).

The assembly comprised by the rear extension (10) on the stapling head, and the tongue (101) invariably associated therewith, is capable of travelling longitudinally with respect to arm (A) along a guide (201) which is invariably attached to said arm (A).

This longitudinal travel is limited in one direction, which corresponds to the staple loading position, by a stop provided on the very extension (10) of the head, and the guide (20) attached to said arm (A), and in the other direction, which corresponds to the stapler working position, by a securing key (301) accommodated inside a housing ($A_2$) on the very arm (A), and provided with a claw (301') which is accommodated in a housing (10') provided at a suitable position upon the rear extension (10) of the stapling head.

With this design, when it is required to load staples, it is simply necessary:

To depress the securing key (301) to make claw (301') disengage from housing (10') and allow free lengthwise travel of the rear extension (10) and its associated tongue (101).

To load the staples by means of inserting their tips into the housings defined by the rear extension (10) and the tongue (101).

To travel the assembly lengthwise in order for the clips to become located against the thruster (102), by means of compressing spring (104).

To depress the securing key (301) in order for its claw (301') to become inserted once again inside the housing (10') on the rear extension (10), thus returning the stapling machine to its working condition.

The stapling machine is also provided with a guiding arrangement between arms (A) and (B) in order to prevent any sideways bending.

In this particular construction as depicted in FIG. 3, such guiding arrangement is comprised of a recess ($B_1$) provided in arm (B), wherein an extension ($A_1$) provided at right angles on the other arm (A) may rest, so that under ordinary circumstances, no contact takes place between extension ($A_1$) and recess ($B_1$) belonging to arms (A) and (B) in this area, but in the event of any sideways bending, recess ($B_1$) acts as a guide for the right angled extension ($A_1$) so as to prevent such sideways bending.

The aforegoing description refers to a paper stapling machine, but the invention is obviously applicable to all kinds of stapling machines for paper or otherwise, which operate on the basis of an arm which travels with respect to the other, or the common motion of two travelling arms, and where the material to be stapled is inserted between them.

I claim:

1. A stapling machine, comprising two elongated arms movable relative to one another, one of the arms carrying an anvil for bending over staple ends, said arms being formed of a single piece having a weakened joint area for rotation; guiding means to prevent sideways bending between said arms and including first means provided on one arm and interacting with second means provided on the other arm; a travelling assembly movable to at least one position for its disassembling to allow access to a stapling area; a stapling head mounted on the other arm, and having a supporting frame with a rear extension and a front formed as a guide for the associated travelling assembly; at least two leaves which, beginning at the arms form a single body with the arms and allow flexible motion in the joint area; and a staple magazine formed by the other arm carrying the stapling head and the rear extension of the supporting frame, the staple magazine being capable of undergoing longitudinal motion with respect to the other arm.

2. A stapling machine as defined in claim 1, wherein said leaves which begin from the arms, converge together forming a cross stiffener which takes up at least a part of the total width of the arms.

3. A stapling machine as defined in claim 2, wherein said leaves are arranged on sloping planes which converge onto the cross stiffener with which they are linked by means of the weakened joint area.

4. A stapling machine as defined in claim 1, wherein said leaves are both arranged on the same plane with one being a continuation of the other, and where, together with the weakened joint area, they form a hollow circular segment.

5. A stapling machine as defined in claim 1, wherein said frame has guide recesses thereon, the travelling assembly associated with the frame being comprised of a front plate and a cover which are joined together and travel in guide recesses on the frame.

6. A stapling machine as defined in claim 5, wherein said front of said frame has two opposing guide walls, each guide recess on the frame (1) being provided with flush stops on its front wall, between which there are at least two recesses located alternatively on each of the two guide walls.

7. A stapling machine as defined in claim 6; further comprising a positioner housed within said travelling assembly and capable of being accommodated in one or the other of the recesses in such a way as to provide intermediate partially dissassembled positions.

8. A stapling machine as defined in claim 7, wherein the positioner is capable of being shifted crosswise between two extreme positions, and is mounted inside a recess on the cover, the positioner being further provided with two side flanges which engage respectively in the recesses on the guide wall so that their intermediate lengths of travel can be limited when either of the side flanges on the positioner comes into contact with one of the flush stops.

9. A stapling machine as defined in claim 7, wherein each flush stop has a lower edge shaped in a slope so that when the positioner is located at the opposite extreme successive position, it tends to assist the travelling assembly to rise.

10. A stapling machine as defined in claim 8, wherein each stop has an upper edge (17) at right angles to each guide wall, so that the return to the working position takes place by horizontal interlocking to prevent any accidental removal of the travelling assembly once the relevant side flange on positioner has passed the flush stop.

11. A stapling machine as defined in claim 7, wherein the recesses are vertically staggered with respect to one another so that once the vertical travel range of the travelling assembly is limited, then simply by shifting the positioner crosswise, the following recess located on the opposing guide wall is reached.

12. A stapling machine as defined in claim 1, wherein the staple magazine is defined by the rear extension on the stapling head and a tongue attached thereto, and between which housings are formed into which the tips of the staples are inserted, these then being compressed in the direction of the stapler head by means of a thruster.

13. A stapling machine as defined in claim 1, wherein said first means is a right-angled extension on said one arm and said second means is a recess on the other arm acting as a guide for the right-angled extension.

14. A stapling machine as defined in claim 1, wherein the one arm possesses a broken section which, from the stapling head, extends along at least a part of its length for the purpose of making the staples impinge at right angles.

* * * * *